US011634926B2

(12) United States Patent
Lin et al.

(10) Patent No.: US 11,634,926 B2
(45) Date of Patent: Apr. 25, 2023

(54) FENCE BRACKET

(71) Applicant: Simpson Strong-Tie Company Inc., Pleasanton, CA (US)

(72) Inventors: Jin-Jie Lin, Livermore, CA (US); David E. Balzhiser, Clements, CA (US); George N. Weinholz, III, Dublin, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 607 days.

(21) Appl. No.: 15/818,525

(22) Filed: Nov. 20, 2017

(65) Prior Publication Data

US 2018/0142496 A1 May 24, 2018

Related U.S. Application Data

(60) Provisional application No. 62/424,970, filed on Nov. 21, 2016.

(51) Int. Cl.
*E04H 17/14* (2006.01)

(52) U.S. Cl.
CPC ..... *E04H 17/1488* (2021.01); *E04H 17/1417* (2013.01); *E04H 17/1447* (2021.01); *E04H 17/1452* (2021.01)

(58) Field of Classification Search
CPC ..... E04B 2001/2644; E04F 2011/1821; E04H 17/1421; E04H 2017/1452; E04H 2017/1473; E04H 17/1488; F16B 7/048; F16B 7/0486; F16B 7/18; F16B 9/052; Y10T 403/3913; Y10T 403/4605; Y10T 403/4681; Y10T 403/4685
USPC ..... 256/65.03, 65.04, 65.05, 65.06, 65.07; 403/189, 232.1, 258, 260
See application file for complete search history.

(56) References Cited

U.S. PATENT DOCUMENTS

| | | | |
|---|---|---|---|
| 949,075 | A | 2/1910 | Hulett |
| 1,089,878 | A | 3/1914 | Steinhauser |
| 1,714,814 | A | 5/1929 | Plimpton |
| 2,317,125 | A | 4/1943 | Barnett |
| 2,364,003 | A | 11/1944 | Scruggs |
| 2,425,025 | A | 8/1947 | Boisselier |
| 2,638,643 | A | 5/1953 | Olson |

(Continued)

FOREIGN PATENT DOCUMENTS

| | | | | |
|---|---|---|---|---|
| GB | 2151743 B | | 7/1985 | |
| GB | 2401616 A | * | 11/2004 | ..... E04H 17/165 |

OTHER PUBLICATIONS

Simpson Strong-Tie Company Inc., Wood Construction Connectors, 2006 Catalog, cover page, p. 178, back page, Catalog C-2006, Simpson Strong-Tie Company, Inc., Pleasanton, CA, United States.

(Continued)

*Primary Examiner* — Josh Skroupa
(74) *Attorney, Agent, or Firm* — James R. Cypher; Charles R. Cypher

(57) ABSTRACT

A connector attached to the end face of a supported member where fasteners are driven through the connector into the end face of the supported member, and then the supported member with the attached connector is positioned to interface on the supporting member with jutting peripheral attachment areas of the connector exposed and available for receiving fasteners that will attach the connector and the fence stringer to the supporting member.

15 Claims, 16 Drawing Sheets

(56) References Cited

U.S. PATENT DOCUMENTS

| | | | | | |
|---|---|---|---|---|---|
| 2,666,238 | A | | 1/1954 | Hagedorn | |
| 2,809,405 | A | * | 10/1957 | Frank | E04B 1/2612 52/702 |
| 3,467,418 | A | | 9/1969 | Redditt | |
| 3,669,480 | A | | 6/1972 | Fugate | |
| 3,833,201 | A | | 9/1974 | Dill | |
| 4,280,686 | A | * | 7/1981 | Wack | E04H 17/1413 256/65.07 |
| 4,498,801 | A | * | 2/1985 | Gilb | F16B 9/052 403/189 |
| 4,526,348 | A | | 7/1985 | Cammack | |
| 4,560,301 | A | | 12/1985 | Glib | |
| 4,572,695 | A | | 2/1986 | Glib | |
| 4,616,950 | A | | 10/1986 | Morris | |
| 4,881,844 | A | * | 11/1989 | Tremblay | A47B 77/06 403/315 |
| 4,899,991 | A | | 2/1990 | Brunkan | |
| 5,042,136 | A | * | 8/1991 | Tremblay | A47B 77/06 29/525 |
| 5,160,211 | A | | 11/1992 | Gilb | |
| 5,173,001 | A | * | 12/1992 | Schunke | F16B 7/187 403/252 |
| 5,186,571 | A | * | 2/1993 | Hentzschel | E04B 1/2608 256/65.06 |
| 5,190,268 | A | | 3/1993 | Espiinueva | |
| 5,259,685 | A | | 11/1993 | Gilb | |
| 5,274,981 | A | | 1/1994 | Commins | |
| 5,328,287 | A | | 7/1994 | Gilb | |
| 5,333,435 | A | | 8/1994 | Leek | |
| 5,372,448 | A | | 12/1994 | Gilb | |
| 5,380,116 | A | | 1/1995 | Colonias | |
| 5,399,044 | A | | 3/1995 | Gilb | |
| 5,402,987 | A | | 4/1995 | Duyck | |
| 5,419,649 | A | | 5/1995 | Gilb | |
| 5,439,201 | A | | 8/1995 | Landreville | |
| 5,488,810 | A | | 2/1996 | Horton | |
| 5,746,535 | A | * | 5/1998 | Kohler | A47B 47/0041 403/258 |
| D399,013 | S | | 9/1998 | Nguyen | |
| 6,022,165 | A | | 2/2000 | Lin | |
| 6,543,751 | B1 | * | 4/2003 | Spruill | E04F 11/1817 256/65.04 |
| 6,607,086 | B1 | | 8/2003 | Gretz | |
| 6,712,543 | B1 | * | 3/2004 | Schmalzhofer | F16B 7/187 403/381 |
| 6,840,020 | B2 | | 1/2005 | Leek | |
| 7,669,836 | B2 | | 3/2010 | Trigg | |
| D744,260 | S | | 12/2015 | Charette | |
| 10,415,617 | B2 | * | 9/2019 | Chen | E06B 9/04 |
| 2007/0154258 | A1 | * | 7/2007 | Knapp | F16B 12/20 403/331 |

OTHER PUBLICATIONS

Simpson Strong-Tie Company Inc., Wood Construction Connectors, 2011-2012 Catalog, cover page, p. 186, back page, Catalog C-2011, Simpson Strong-Tie Company, Inc., Pleasanton, CA, United States.

pylex.com, Pylex.com Web Pages, 2011, 4 pages, Canada.

USP Lumber Connectors,USP Full Line Catalog, 1998, cover page, back page, pp. 66 and 87, United Steel Products Company, United States.

United Steel Products Company, Kant-Sag Construction Hardware Full Line Catalog, Fence Bracket FX Series, Header Brace H Series, 1984, cover page, back page, pp. 32 and 33, United Steel Products Company, Montgomery, Minnesota, United States.

Southeastern Metals Manufacturing Co., Inc., Construction Hardware, Plate, 1989, cover page, p. 26, Southeastern Metals Manufacturing Co., Inc., Jacksonville, Florida, United States.

* cited by examiner

FENCE BRACKET

BACKGROUND

The present invention relates to a connector for attaching the end of one member to the side of another, in particular for attaching a fence stringer or railing to a fence post.

There are a number of connectors suitable for attaching the end of an elongated member to the side of another structural member in general, as well as a number of patented connectors for making the particular attachment in a fence.

U.S. Pat. No. 1,089,878 which issued in 1914 to Alfred Steinhasuser teaches a connector that attaches a horizontally disposed brace to upright studs. The connector is designed to attach to the wood members with nail prongs rather than nails. The central portion of the connector is attached to the end of the horizontal brace with centrally located nail prongs and oppositely disposed nail prongs at the ends of the elongated connector are driven into the side face of the upright stud.

U.S. Pat. No. 3,833,201 which issued in 1974 to Joe E. Dill teaches a generally u-shaped connector that is suitable for attaching fence stringers to a round post. The central portion of the connector is attached to the end of the stringer with nails and the angled ends of the elongated connector are attached to the curved surface of the post with nails. Embossments are added to the different portions of the connector to strengthen the different portions. According to the patent, the central portion that connects to the end of the stringer can be formed with central tab extensions or tongues that according to the inventor create a larger bearing surface for the end of the stringer. Also according to the patent, the tongues make bending between the central attachment portion and the end attachment portions easier, because the tongues are formed in such a manner as to reduce the amount of material that needs to bend between the central attachment portion and the end attachment portion.

U.S. Pat. No. 4,280,686 which issued in 1981 to David T. Wick teaches an elongated connector that is suitable for attaching fence stringers to a post. The central portion of the connector is attached to the end of the stringer with nails and the ends of the elongated connector are attached to the post with nails. According to the patent, the material of the connector can be bent upon itself to form a ledge for supporting the stringer.

U.S. Pat. No. 4,616,950 which issued in 1986 to Tom C. Morris also teaches a generally U-shaped connector that is suitable for attaching fence stringers to a post. The upstanding sides of the generally u-shaped member engage the sides of the stringer, and additional channel shaped members overlay the sides of the generally u-shaped member. Extensions of the central portion of the u-shaped member attach the connector to the post.

United Kingdom Patent 2,401,616 which issued in 2004 teaches a connector that is similar to the generally u-shaped connector of U.S. Pat. No. 3,833,201; however, it differs from that patent in that the extending tongues from the central portion are used to attach the connector to the post and the end sections of the connector wrap around the stringer and are used to attach the connector to the stringer.

The present invention provides a uniquely shaped connector that is particularly suited for connections where the supported member and the supporting member are expected to shift their positions with respect to each other. Fence members are particularly prone to shifting either through shrinkage of the members, if they are made from wood, or through forces exerted on the fence, such as by the ground shifting or wind loading.

SUMMARY OF THE INVENTION

It is an object of the present invention to provide a connection between a fence stringer and a fence post whereby shrinkage and contraction of the fence stringer and/or the fence post will not weaken the connection between the two. This object is accomplished in part by forming the connector so that it can flex and bend between the area of attachment to the post and the area of attachment to the fence stringer.

It is another object of the present invention to provide a connector that is inexpensively made and easily attached to both the first and second members.

The present invention provides a connection between a supported member and a supporting member using a connector and a plurality of separate fasteners, wherein the supported member has an end face and the supporting member has a side face that is in generally abutting relation with the end face of the supported member, and the connector has a generally planar central attachment area bracketed by one or more generally planar peripheral attachment areas. The central attachment area of the connector is generally aligned with the peripheral attachment areas and the central attachment area interfaces with the end face of the supported member and the peripheral attachment areas interface with the side face of the supporting member. The plurality of separate fasteners are used to attach the connector to the supported and supporting members and they have elongated shanks and tips and are only either driven through the central attachment area and through the end face of the supported member with their tips embedded in the supported member, or they are driven through the peripheral attachment areas and through the side face of the supporting member with their tips embedded in the supporting member.

The connector is preferably an elongated member having a major axis, a minor axis, and a depth axis, and the connector is elongated with respect to the major axis such that the connector extends father along the major axis than it does along the minor axis, and the connector is relatively thin such that the connector extends farther along the minor axis than it does along the depth axis.

According to the present invention, the peripheral attachment areas extend away from the central attachment area sufficiently that they present exposed areas over which the end face of the supported member does not overlie and extend past the one or more longitudinal sides of the supported member.

According to the present invention, the central attachment area joins with the peripheral attachment areas at junctions, and the central attachment area has a selected cross-sectional area in a plane defined by the lateral axis and the depth axis at a selected location away from the junctions with the peripheral attachment areas, and the junctions where the peripheral attachment areas join with the central attachment area have cross-sectional areas in the plane defined by the lateral axis and the depth axis that are much less than that of the selected cross-sectional area of the central attachment area at the selected location away from the junctions with the peripheral attachment areas.

According to the present invention, the central attachment area and peripheral attachment areas of the connector are formed with one or more openings the plurality of separate fasteners, and preferably, the openings for receiving the plurality of separate fasteners are only provided in the central attachment area and the peripheral attachment areas.

According to the present invention, the central attachment area is formed with left and right side strengthening areas that are disposed laterally from each other on the lateral axis of the connector and the strengthening areas extend in the direction of the longitudinal axis. The left and right side strengthening areas can be formed with longitudinally extending embossments. The left and right side strengthening areas can be formed with longitudinally extending flanges that jut outwardly from the central attachment along the depth axis. The strengthening areas are formed with longitudinal ends and the longitudinal ends of the strengthening areas are disposed adjacent the peripheral attachment areas.

DETAILED DESCRIPTION OF THE DRAWINGS

FIG. 6 is a top view of the connector of FIG. 5. The bottom view is similar.

FIG. 7 is a front view of the connector of FIG. 5. The back view is similar.

FIG. 8 is a right side view of the connector of FIG. 5. The left side view is similar.

FIG. 10 is a top view of the connector of FIG. 9. The bottom view is similar.

FIG. 11 is a front view of the connector of FIG. 9. The back view is similar.

FIG. 12 is a right side view of the connector of FIG. 9. The left side view is similar.

FIG. 14 is a top view of the connector of FIG. 13. The bottom view is similar.

FIG. 15 is a front view of the connector of FIG. 13. The back view is similar.

FIG. 16 is a right side view of the connector of FIG. 13. The left side view is similar.

FIG. 18 is a top view of the connector of FIG. 17. The bottom view is similar.

FIG. 19 is a front view of the connector of FIG. 17. The back view is similar.

FIG. 20 is a right side view of the connector of FIG. 17. The left side view is similar.

FIG. 23 is a top view of the connector of FIG. 22. The bottom view is similar.

FIG. 24 is a front view of the connector of FIG. 22. The back view is similar.

FIG. 25 is a right side view of the connector of FIG. 22. The left side view is similar.

DETAILED DESCRIPTION OF THE PREFERRED EMBODIMENT

Figure 1:
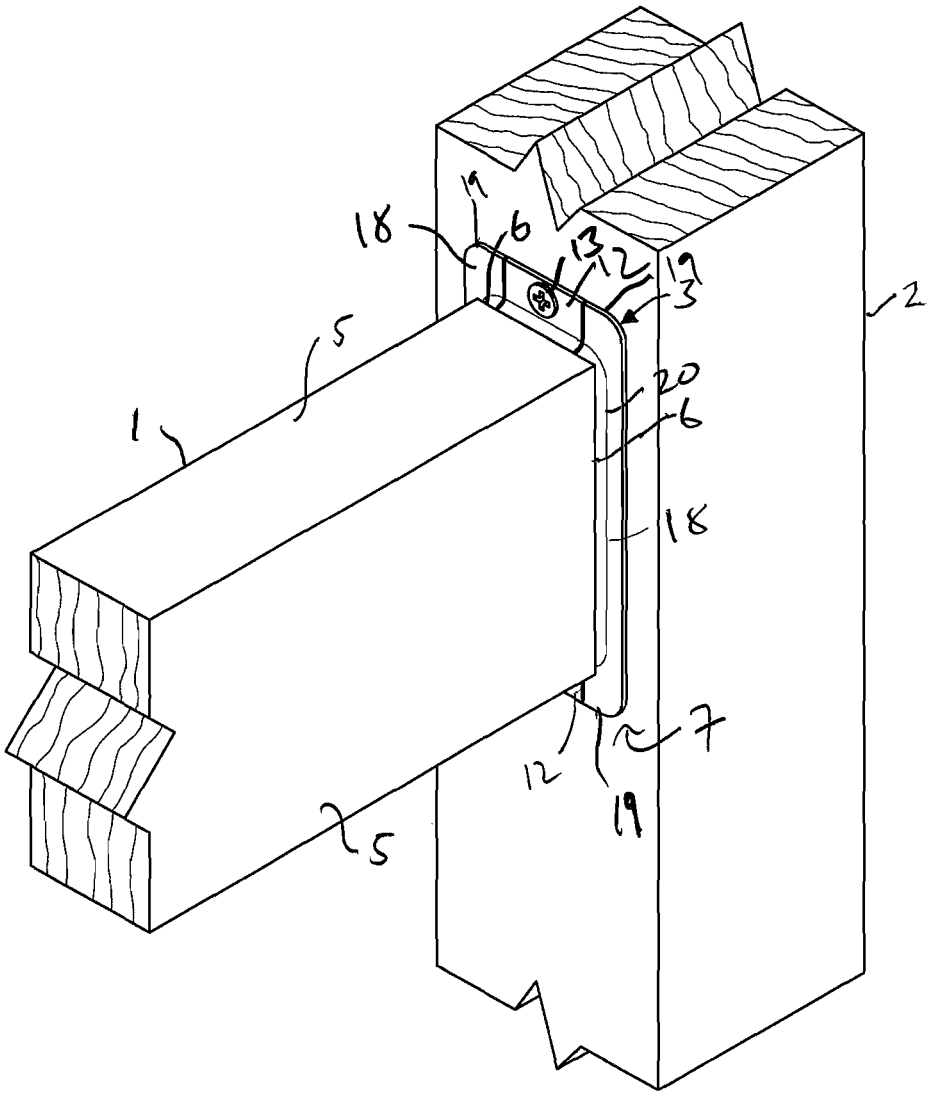
FIG. 1 is a perspective view of the connection made with one embodiment of the connector.
Figure 2:
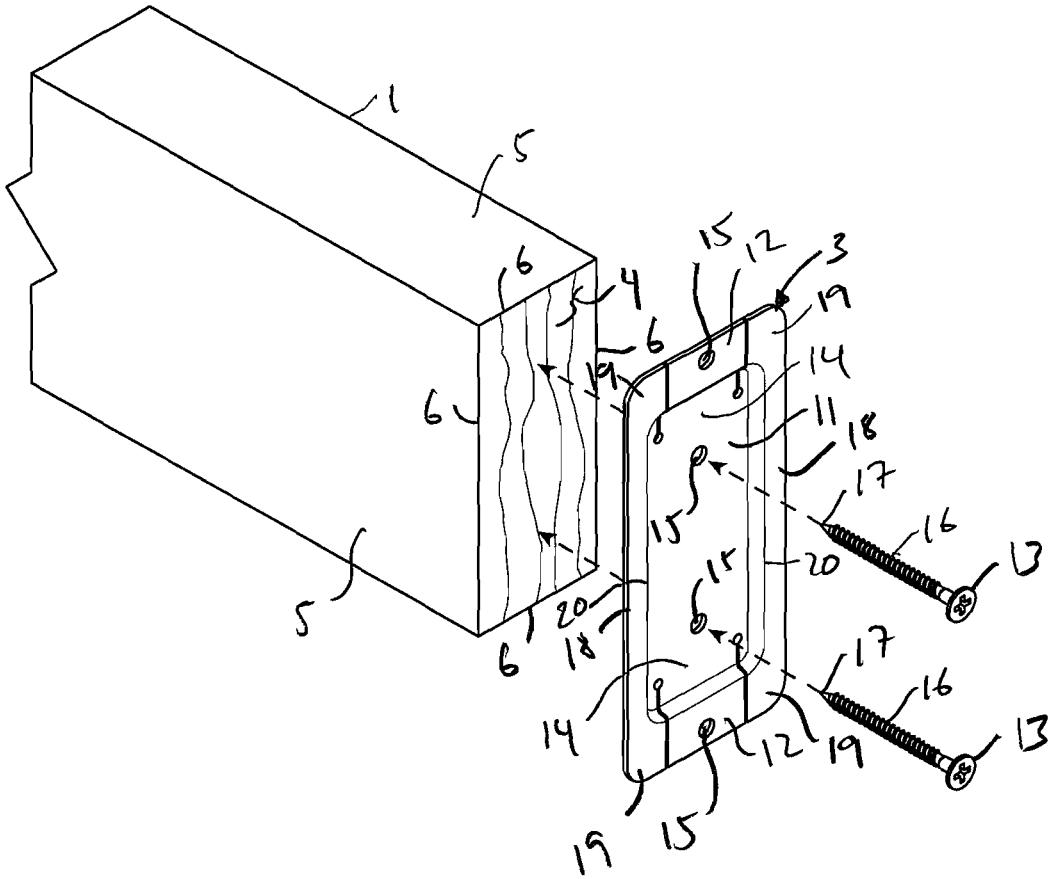
FIG. 2 is an exploded perspective view of the connection between the connector of FIG. 1 and the supported structural member.
Figure 3:
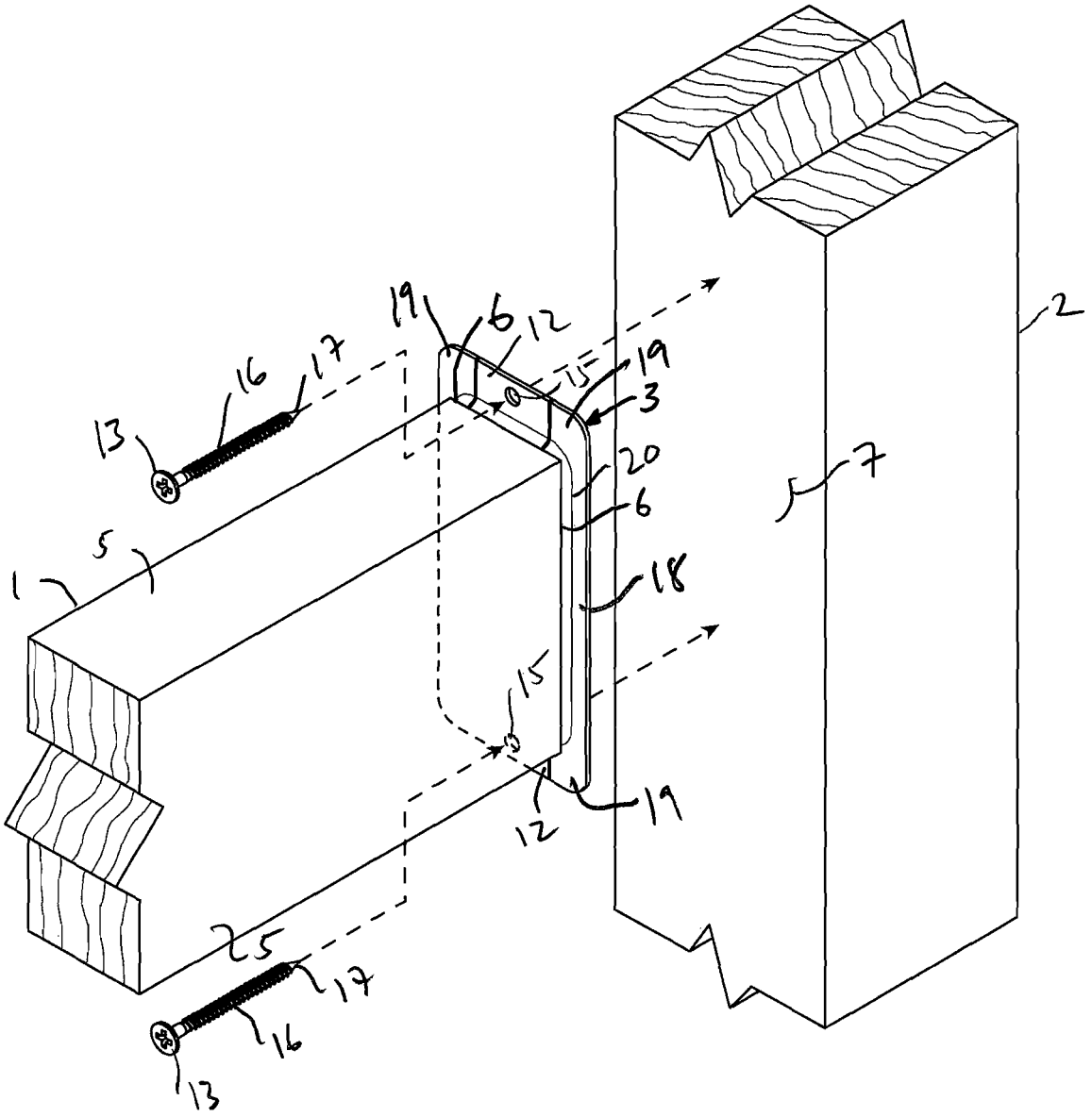
FIG. 3 is a partial-exploded perspective view of the connection of FIG. 1.
Figure 4:
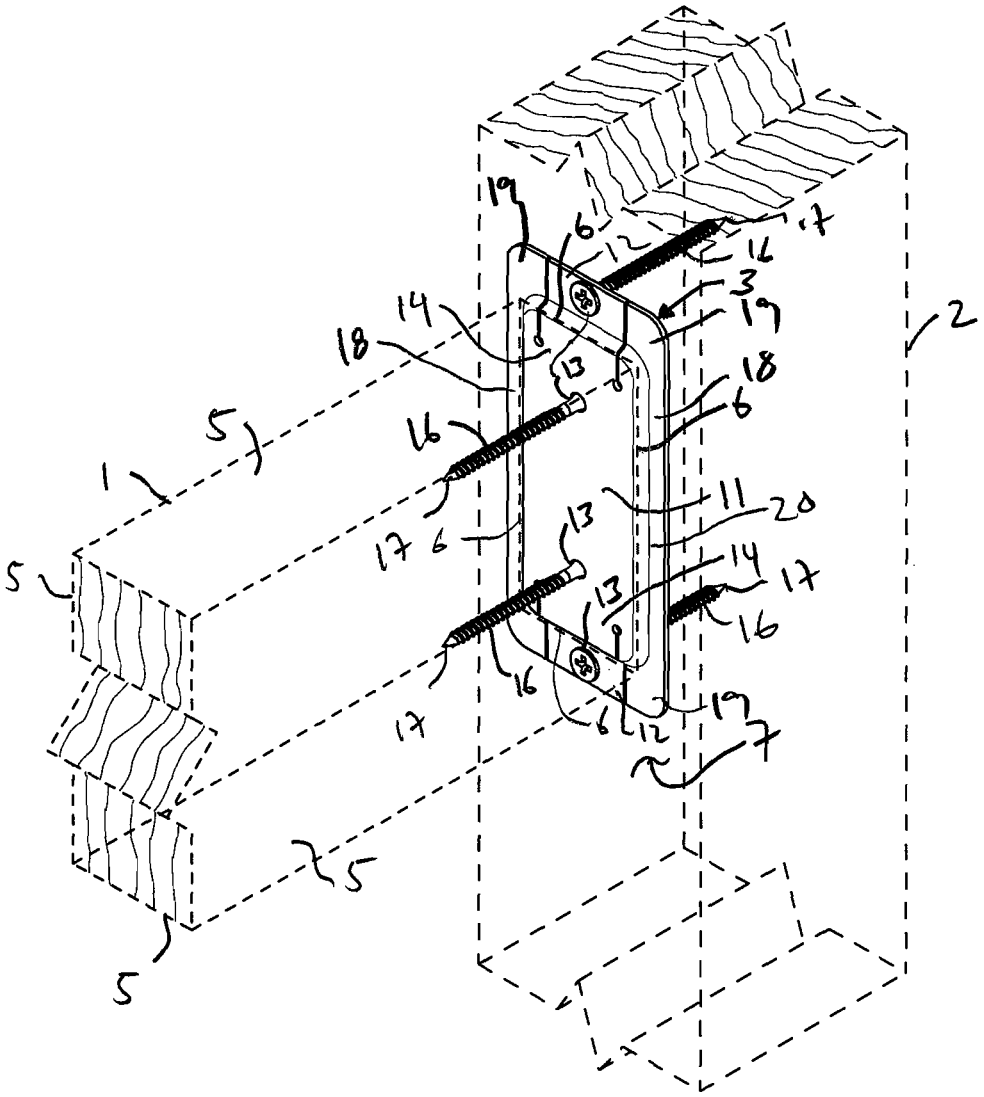
FIG. 4 is a perspective view similar to FIG. 1 except the supported and supporting structural members are shown in outlines.

As shown in FIG. 1, the present invention provides a connection between a supported member 1 and a supporting member 2. A connector 3 attaches the supported member 1 to the supporting member 2. The supported member 1 is preferably a longitudinally elongated member with a generally planar end face 4. The supported member 1 has one or more lateral sides 5 that meet with the end face 4 at one or more end edges 6. The connector 3 preferably attaches to the end face 4 of the supported member 1.

The supporting member 2 is preferably an elongated member with a generally planar side face 7. The connector 3 preferably attaches to the side face 7 of the supporting member 2. The side face 7 of the supporting member 2 is in generally abutting relation with the end face 4 of the supported member 1, with the end face 4 of the supported member 1 disposed parallel to the side face 7 of the supporting member 2. While the end face 4 and the side face 7 are in a generally abutting relationship, there is sufficient space between the side face 7 and the end face 4 to place the connector 3 between them. Furthermore, the connector 3 of the present invention is specifically designed so that it can accommodate spreading movement between the end face 4 and the side face 7 or situations where the selected distance between the end face 4 and the side face 7 is larger than desired, as when the supported member 1 is cut too short. The connector 3 is designed to accommodate a ¼" gap between the end face 4 and the side face 7.

Figure 5:
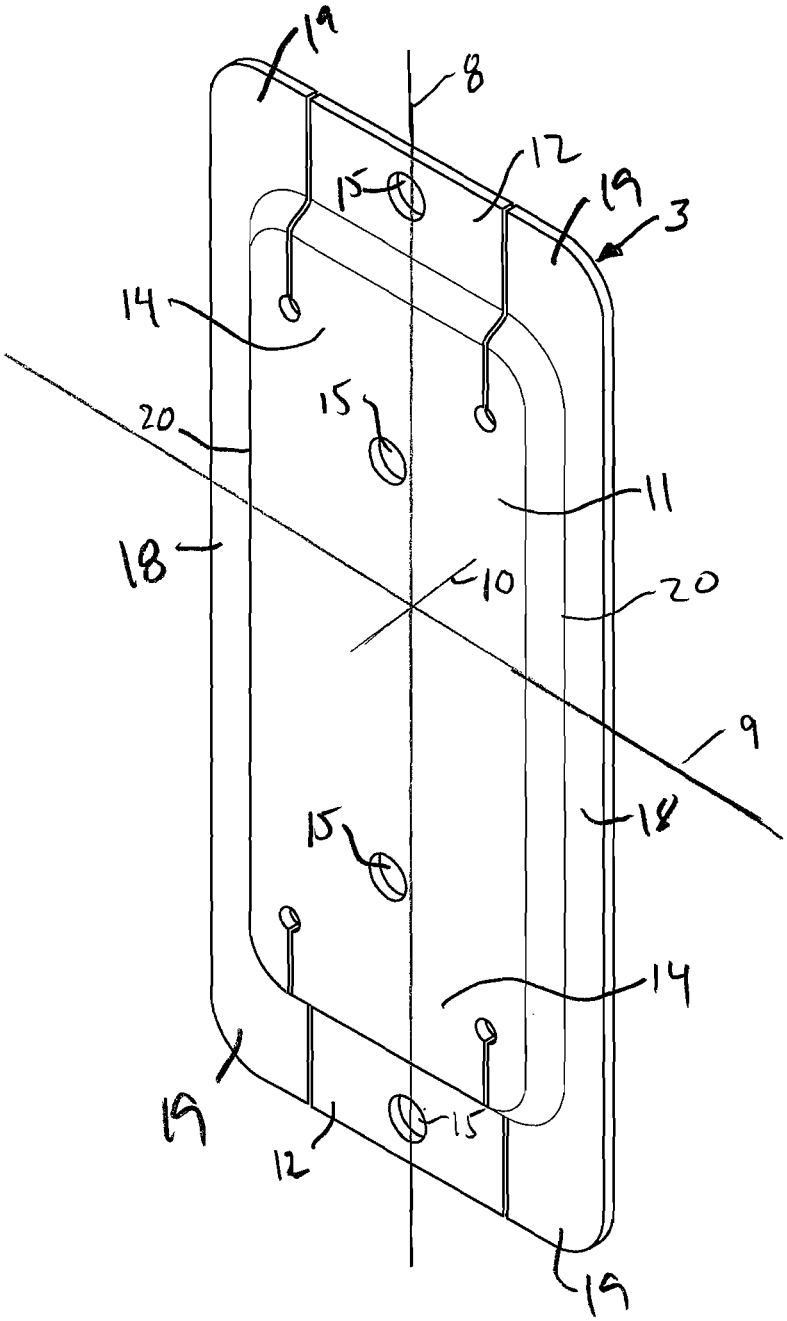
FIG. 5 is a perspective view of the connector of FIG. 1.
Figure 6:
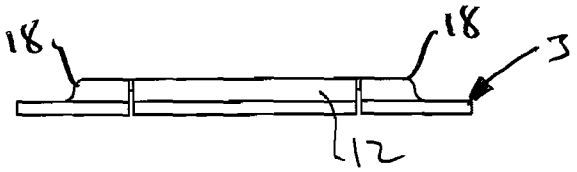
Figure 7:
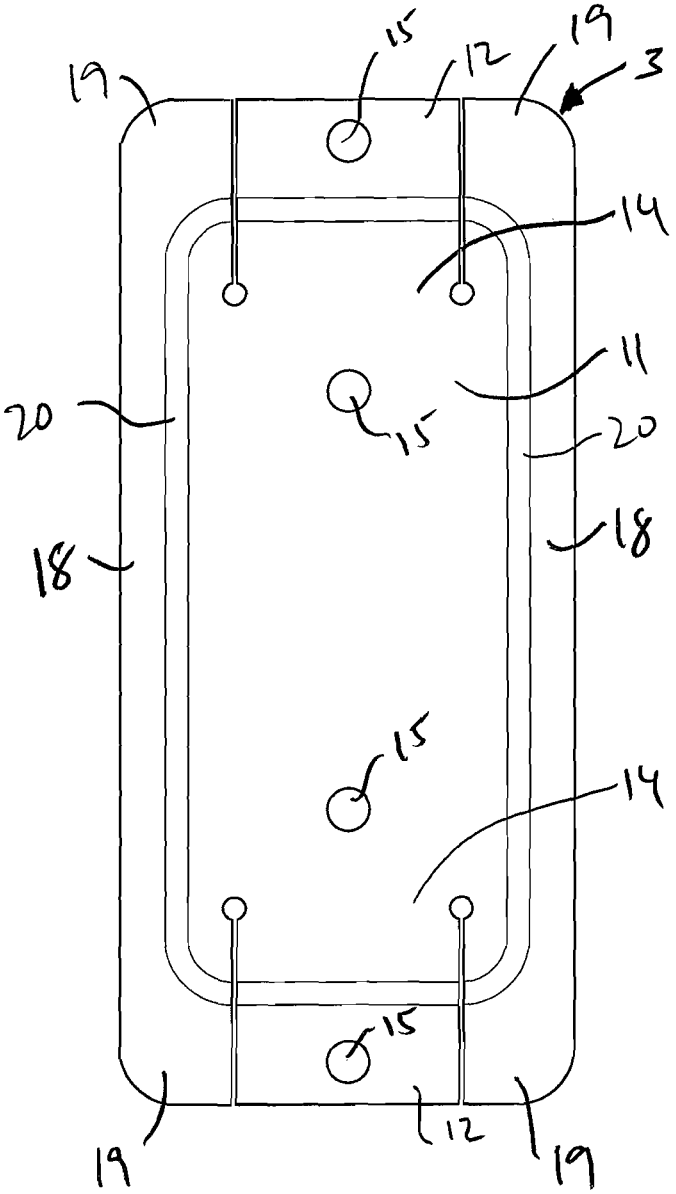
Figure 8:
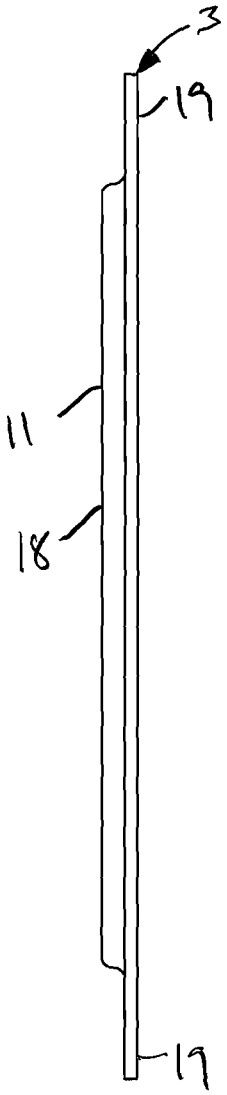

As shown in FIG. 5, the connector 3 of the present invention is a generally planar member. The connector 3 is preferably an elongated member having a longitudinal or major axis 8, a lateral or minor axis 9, and a depth axis 10. Preferably, the connector 3 is elongated with respect to the major axis 8 such that the connector 3 extends father along the major axis 8 than it does along the minor axis 9. Preferably, the connector 3 is relatively thin such that the depth of the connector 3 is much less than its width along the minor axis 9 is or its length along the major axis 8.

The connector 3 of the present invention has a central attachment area 11 for attaching to the supported member 1, and a plurality of peripheral attachment areas 12 for making the connection to the supporting member 2 at a plurality of different locations. The peripheral and central attachment areas 12 and 11 are generally aligned members. The peripheral attachment areas 12 preferably bracket the central attachment area 11 with the central attachment area 11 disposed in between the two peripheral attachment areas 12. When the central attachment area 11 is connected to the supported member 1, the peripheral attachment areas 12 should extent outwardly from the central attachment area 11 sufficiently that they present exposed area that can receive fasteners 13 there through when the peripheral attachment areas 12 interface with the side face 7 of the supporting member 2. While the central attachment area 11 and the peripheral attachment areas 12 may have some contours and bends and are not completely planar member, the central attachment area 11 and the peripheral attachment areas 12 generally lie in the generally planar interface between the planar end face 4 of the supported member 1 and the planar side face 7 of the supporting member 2.

The connector 3 of the present invention is preferably a unitary member, made from sheet steel.

Preferably, the cross-sectional area of the connector 3 in the plane defined by the lateral axis 9 and the depth axis 10 at the central attachment area 11 is relatively large and the junctions 14 where the peripheral attachment areas 12 meet the central attachment area 11 have cross-sectional areas that are much less than that of the central attachment area 11. This allows the connector 3 to bend and flex at the reduced cross-sectional areas at the junctions 14 between the peripheral attachment areas 12 and the central attachment area 11.

The central and peripheral attachment areas 11 and 12 of the connector 3 of the present invention are preferably formed with one or more openings 15 that are specifically located and designed to receive specified fasteners 13 to connect the central attachment area 11 to the supported member 1 and to connect the peripheral attachment areas 12 to the supporting member 2. The central attachment area 11 is preferably formed with a plurality of openings 15, in particular three openings 15, spaced from each other both longitudinally and laterally.

Openings 15 for receiving the fasteners 13 are only provided in the central and peripheral attachment areas 11 and 12, and the fasteners 13 are generally elongated members having elongated shanks 16 that define the longitudinal axes of the fasteners and end in tips 17. When the connection is made and the fasteners 13 are inserted through the openings 15 and into the supported and the supporting members 1 and 2, the elongated shanks 16 of the fasteners 13 extend generally along the depth axis 10 of the connector 3. The fasteners 13 have tips 17 that are driven first into the supported or supporting member 1 or 2. The tips 17 of the fasteners 13 that are driven through the peripheral attachment areas 12 and into the supporting member 2 are driven in the opposite direction along the depth axis 10 of the connector 3 from the tips 17 of the fasteners 13 that are driven through the central attachment area 11 and into the supported member 1.

Figure 17:
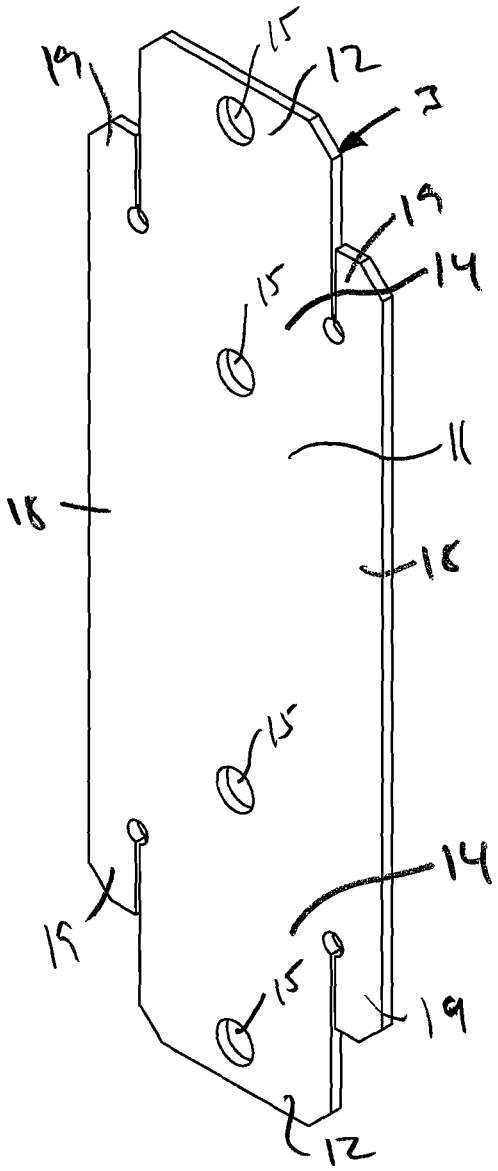
FIG. 17 is a perspective view of an alternate connector.
Figure 18:
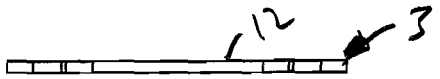
Figure 19:
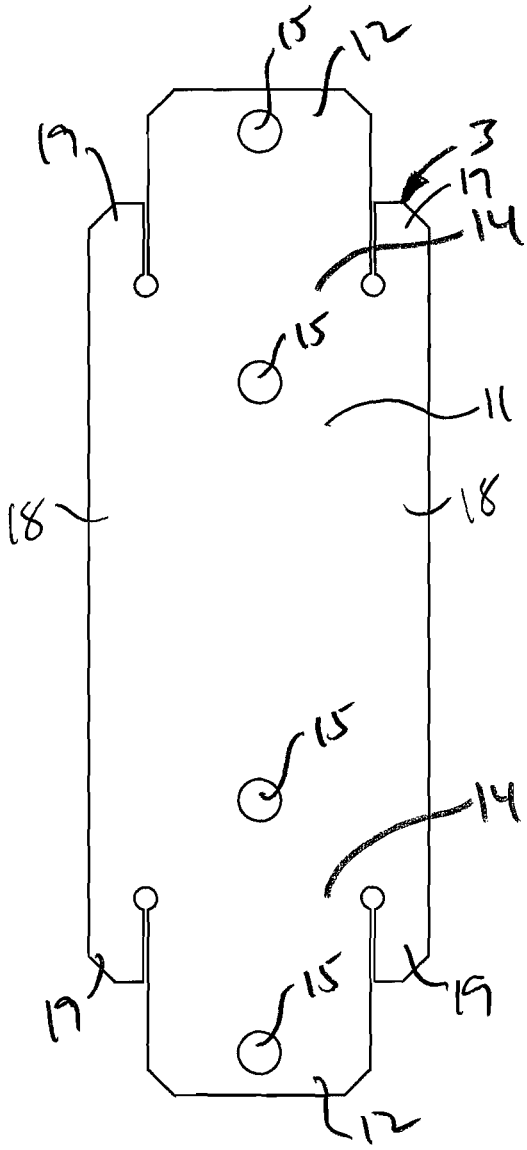
Figure 20:
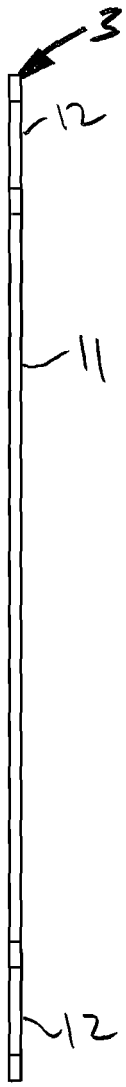

As shown in FIG. 17, the central attachment area 11 preferably has a selected maximum width on the minor axis 9 and the peripheral attachment areas 12 are formed so that the junctions 14 between the peripheral attachment areas 12 and the central attachment 11 has a width on the minor axis 9 that is substantially less than that of the selected maximum width of the central attachment area 11. Similarly, the central attachment area 11 has a selected cross-sectional area in a plane defined by the minor axis 9 and the depth axis 10 at a selected location away from the junctions 14 with the peripheral attachment areas 12, and the junctions 14 where the peripheral attachment areas 12 join with the central attachment area 11 have cross-sectional areas in the plane defined by the minor axis 9 and the depth axis 10 that are much less than that of the selected cross-sectional area of the central attachment area 11 at the selected location away from the junctions 14 with the peripheral attachment areas 12.

Figure 9:
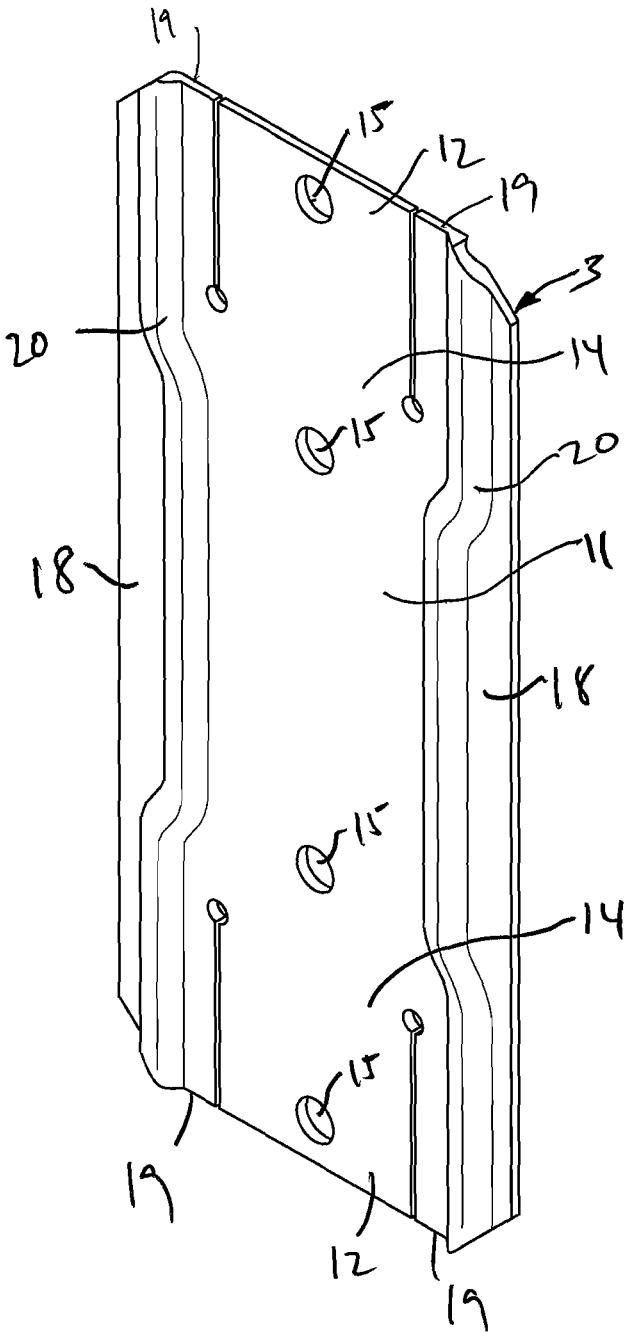
FIG. 9 is a perspective view of an alternate connector.
Figure 10:
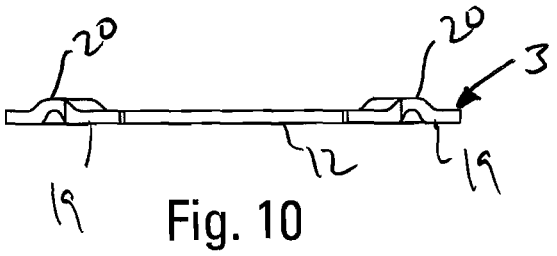
Figure 11:
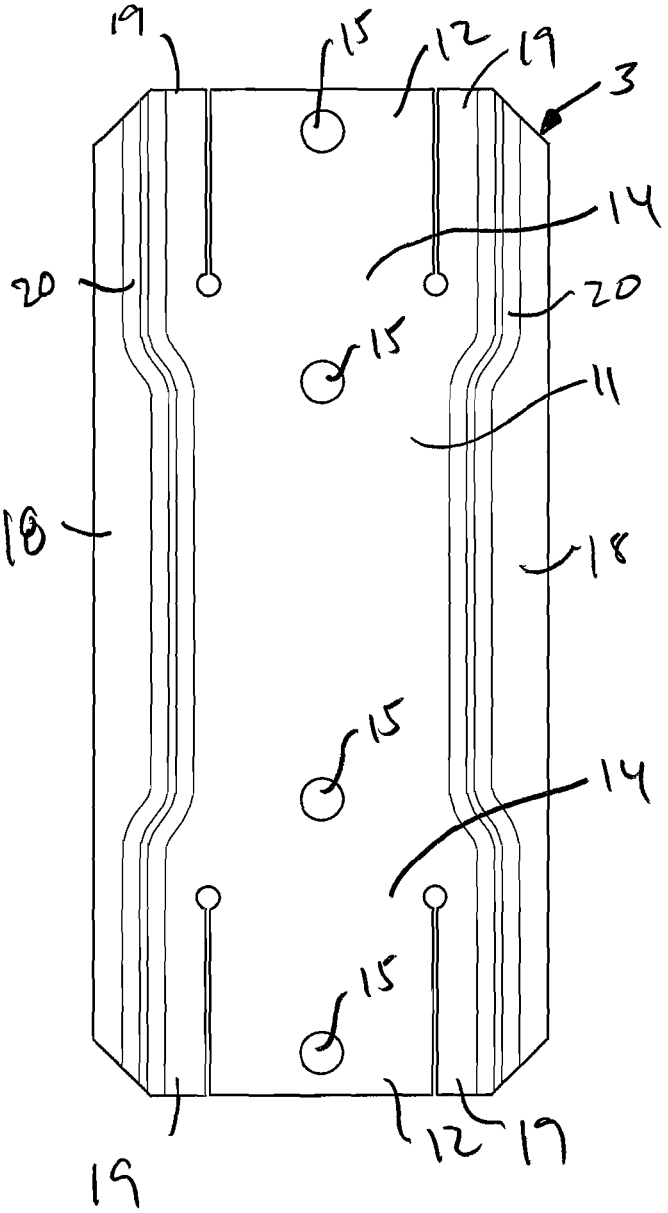
Figure 12:
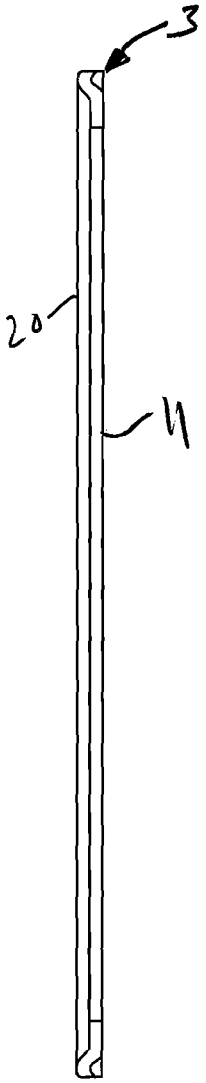
Figure 13:
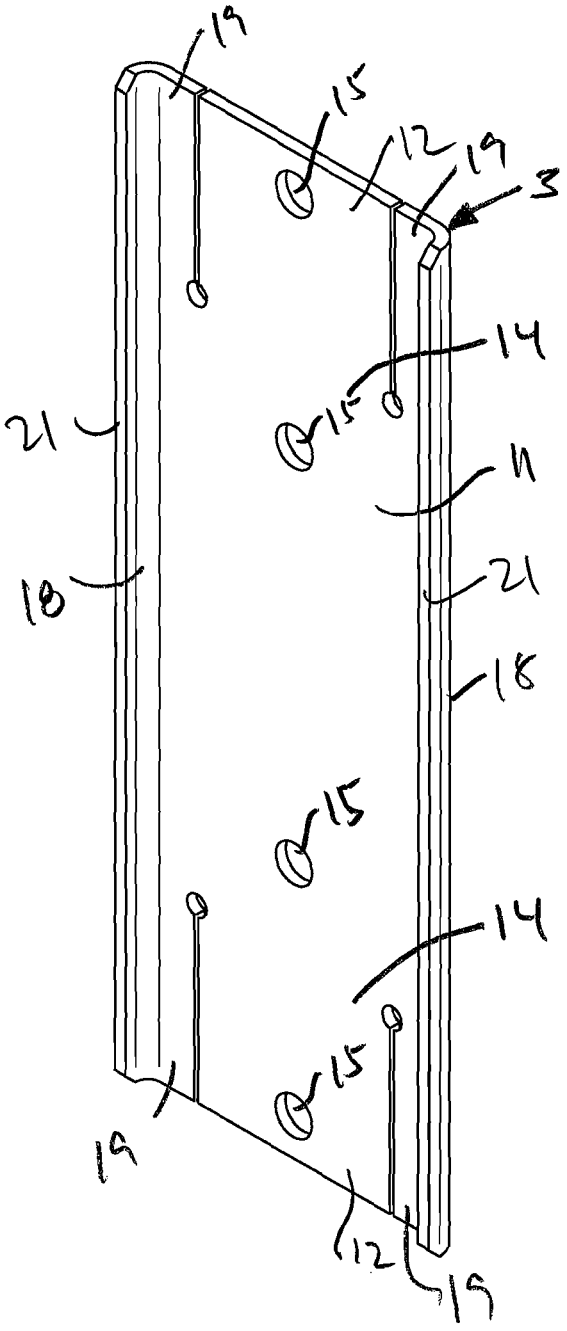
FIG. 13 is a perspective view of an alternate connector.
Figure 14:
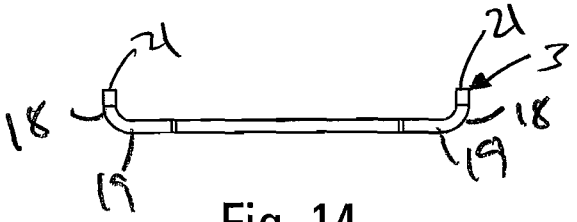
Figure 15:
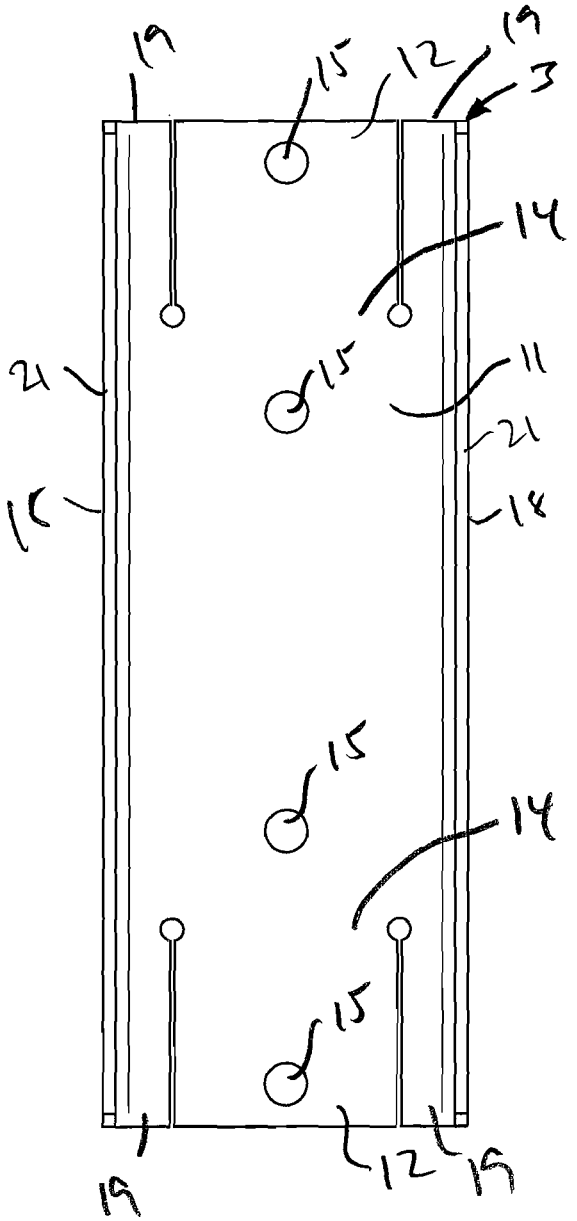
Figure 16:
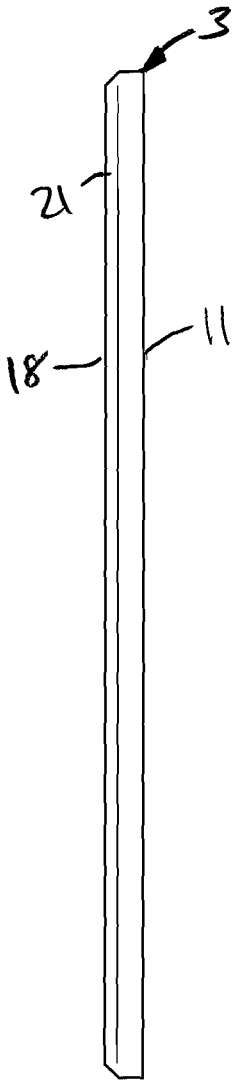
Figure 22:
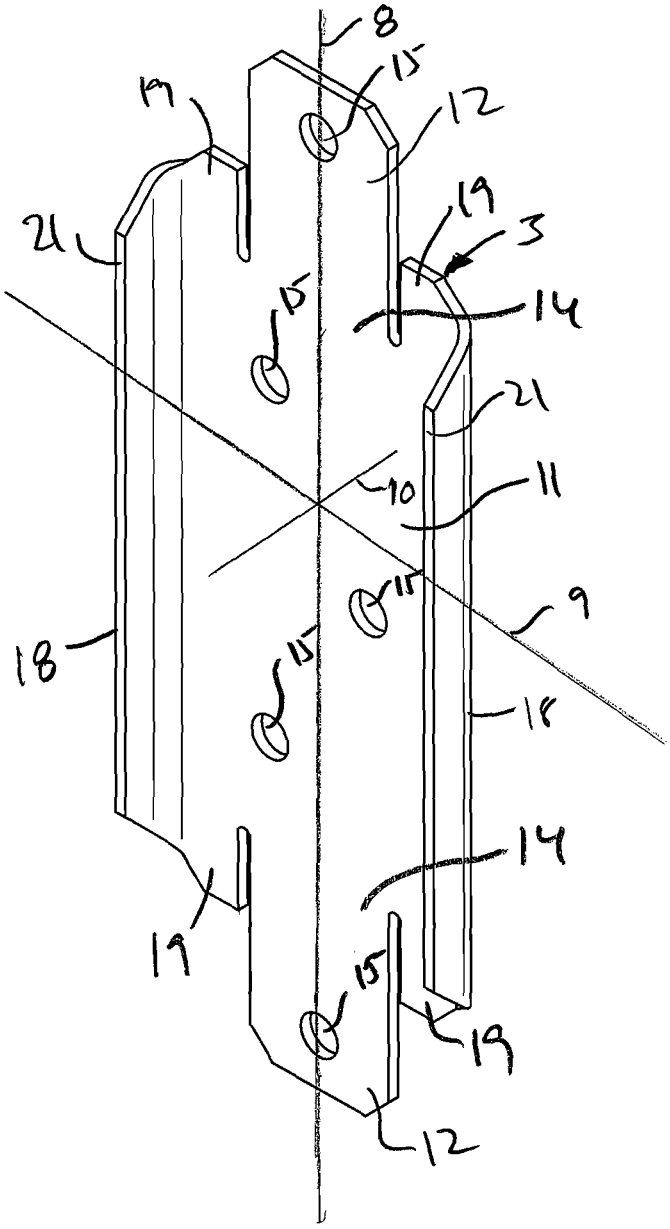
FIG. 22 is a perspective view of the alternate connector shown in FIG. 21.
Figure 23:
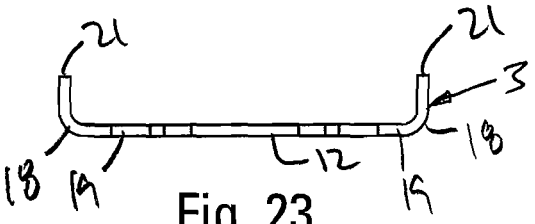
Figure 24:
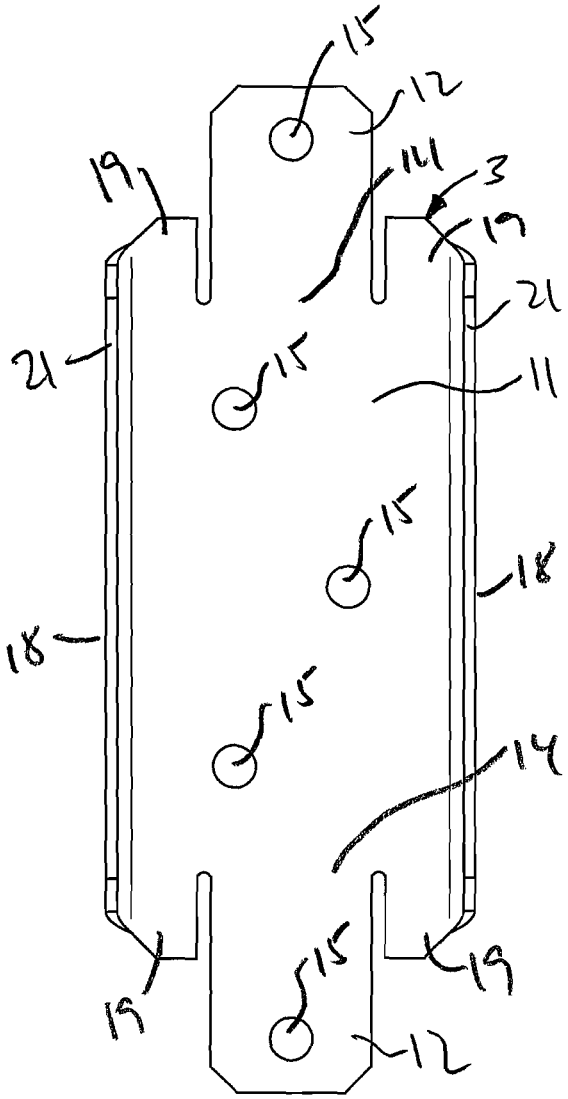
Figure 25:
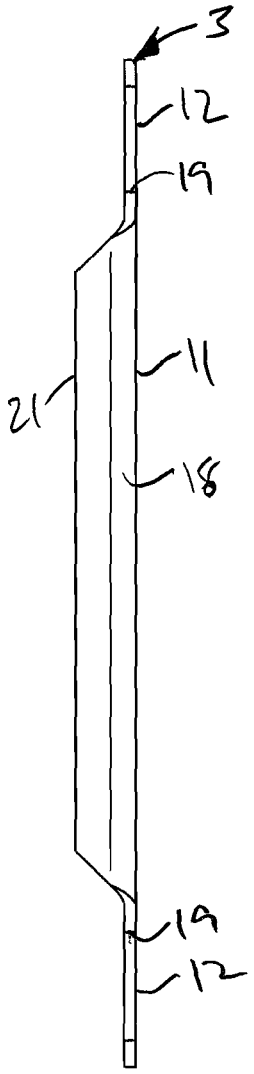
Figure 26:
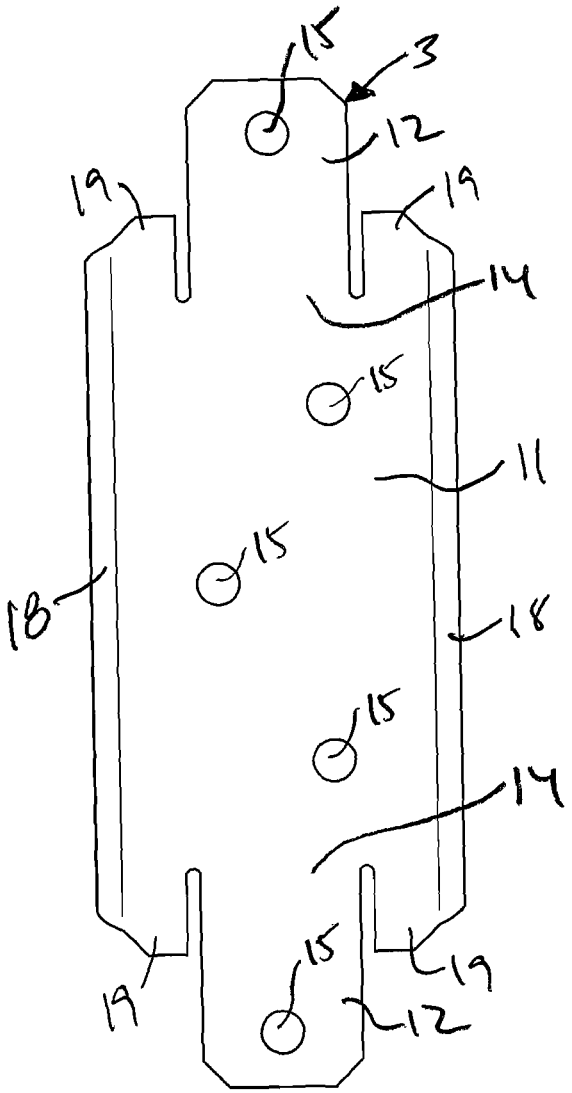
FIG. 26 is a back view of the connector of FIG. 22.

The central attachment area 11 is formed with left and right side strengthening areas 18 that are disposed laterally from each other on the lateral or minor axis 9 of the connector 3 and the strengthening areas 18 extend in the direction of the longitudinal or major axis 8. The strengthening areas 18 are connected to each other only through the central attachment area 11 disposed between them. The longitudinal ends 19 of the strengthening areas 18 are disposed adjacent but spaced away from the peripheral attachment areas 12 and in generally the same plane as the peripheral attachment areas 12. Preferably, the strengthening areas 18 of the central attachment area 11 are attached to the peripheral attachment areas 12 only through the junctures or junctions 14 between the central attachment area 11 and the peripheral attachment areas 12. As shown in FIGS. 5 and 9, the left and right side strengthening areas 18 can be formed with longitudinally extending embossments 20. As shown in FIGS. 13 and 22, the left and right side strengthening areas 18 are formed with longitudinally extending flanges 21 that jut outwardly from the central attachment along the depth axis 10. The side strengthening flanges 21 increase the depth of the generally planar connector 3; however, the depth of the connector 3 remains relatively small compared to both the length and the width of the connector 3.

Figure 21:
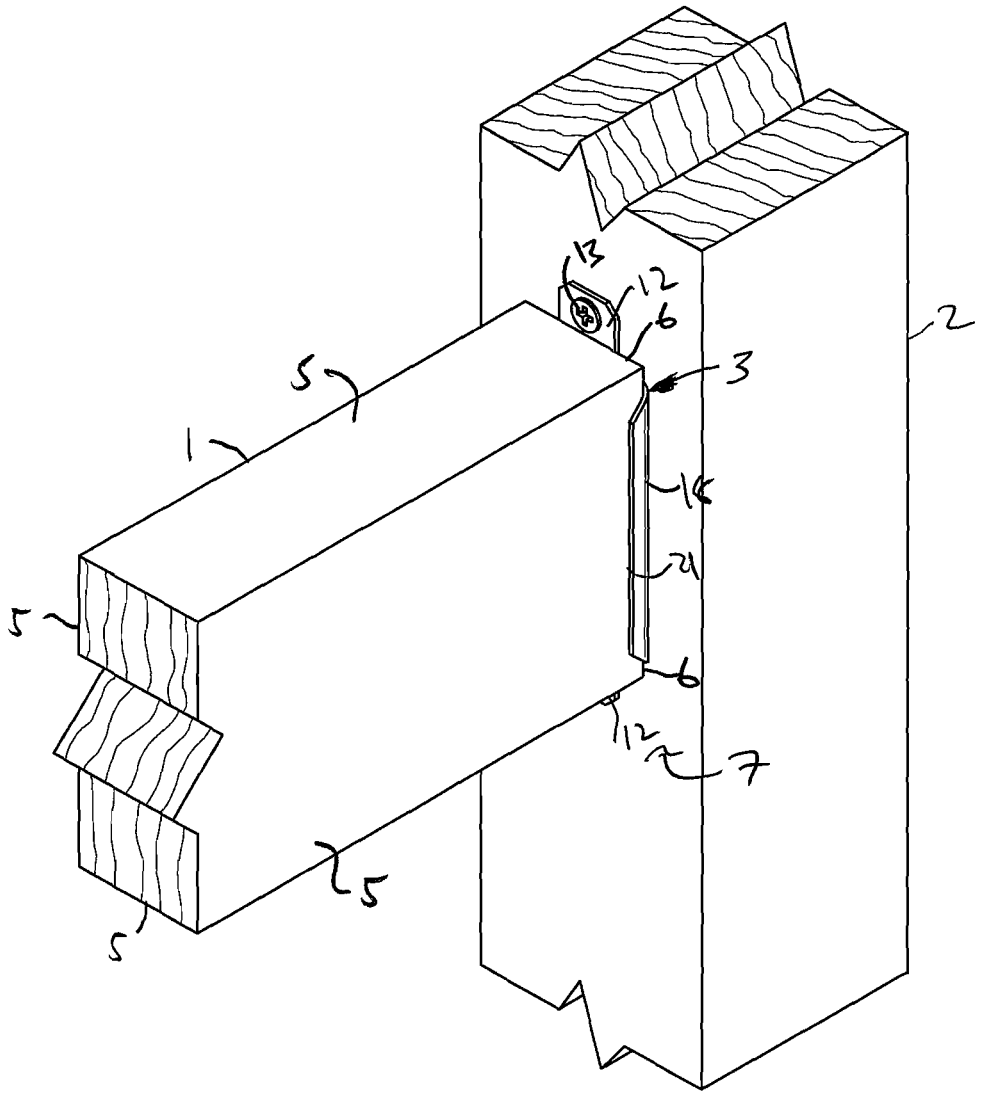
FIG. 21 is a perspective view of the connection made with another embodiment of the connector.

As shown in FIG. 13, the left and right strengthening flanges 21 can be simple 90 degree bends in the material at the left and right edges of the central attachment area 11. As shown in FIGS. 9-12, the strengthening areas can have embossments 20 in the left and right edge portions of the central attachment area 11. As is also shown in FIG. 13, the left and right strengthening areas 18 of the central attachment area 11 can extend the length of the connector 3, or as shown in FIG. 22, the left and right strengthening areas 18 of the central attachment area 11 can extend less than the full length of the connector 3. The strengthening side areas 18 help the central attachment area 11 resist bending such that the fasteners 13 stay anchored in the supported member 1 when the end face 4 of the supported member 1 and the side face 7 of the supporting member 2 are separated more than is desirable. As is shown in FIG. 21, preferably the flanges 21 wrap closely around the end edges 6 where parallel lateral sides 5 of the supported member 1 meet the end face 4 of the supported member 1, and the flanges 21 closely interface and overlap with portions of the parallel lateral sides 5. This helps with the positioning of the connector 3 on the supported member 1.

As shown in FIG. 1, the peripheral attachment areas 12 can be formed with bends. The bends in the peripheral attachment areas 12 strengthen the peripheral attachment areas 12. As shown in FIG. 1, the bends in the peripheral attachment area 12 also slightly offset the location of the fastener openings 15 in the peripheral attachment area 12 from the location of the fastener openings 15 in the central attachment area 11; however, the peripheral and central attachment areas 12 and 11 are still generally aligned and lie in the same general plane defined between the interface between the planar end face 4 of the supported member 1 and the side face 7 of the supporting member 2.

In use, preferably, the connector 3 of the present invention is first attached to the end face 4 of the stringer or supported member 1 by driving screws 13 through the connector 3 into the end face 4 of the fence stringer 1, and then the stringer 1 with the attached connector 3 is positioned to interface on the post or supporting member 2, with the jutting peripheral attachment areas 12 of the connector 3 exposed and available for receiving fasteners 13 that will attach the connector 3 and the fence stringer 1 to the fence post 2.

We claim:

1. A connection between a supported member and a supporting member using a connector and a plurality of separate fasteners, the connection comprising:

a. the supported member having an end face;

b. the supporting member having a side face that is in generally abutting relation with the end face of the supported member;

c. the connector, the connector having a generally planar central attachment area bracketed by at least a pair of generally planar peripheral attachment areas, the central attachment area being generally aligned with the peripheral attachment areas, the central attachment area interfacing with the end face of the supported member and the peripheral attachment areas interfacing with the side face of the supporting member; wherein d. the plurality of separate fasteners that are used to attach the connector to the supported and supporting members have elongated shanks and tips and are only either driven through the central attachment area and through the end face of the supported member with their tips embedded in the supported member, or they are driven through the peripheral attachment areas and through the side face of the supporting member with their tips embedded in the supporting member, with each of the peripheral attachment areas receiving at least one of the plurality of separate fasteners therethough, and with the central attachment area receiving at least one of the plurality of separate fasteners therethrough;

e. the central attachment area is formed with left and right side strengthening areas that are disposed laterally from each other on the lateral axis of the connector with the central attachment area disposed between the left and right side strengthening areas, and the strengthening areas are elongated and extend in the direction of the longitudinal axis;

f. the central attachment area joins with the peripheral attachment areas at junctions, g. the central attachment area has a selected cross-sectional area in a plane defined by the minor axis and the depth axis at a selected location away from the junctions with the peripheral attachment areas, h. the junctions where the peripheral attachment areas join with the central attachment area have cross-sectional areas in the plane defined by the minor axis and the depth axis that are much less than that of the selected cross-sectional area of the central attachment area at the selected location away from the junctions with the peripheral attachment areas; and i. the central attachment area joins with the peripheral attachment areas at junctions and left and right side strengthening areas extend in the direction of the longitudinal axis past the junctions.

2. The connection of claim 1, wherein:

the connector is elongated with respect to the longitudinal axis such that the connector extends farther along the longitudinal axis than it does along the lateral axis, and the connector is relatively thin such that the connector extends farther along the lateral axis than it does along the depth axis.

3. The connection of claim 1, wherein:

the peripheral attachment areas extend away from the central attachment area sufficiently that they present exposed areas over which the end face of the supported member does not overlie and extend past the one or more longitudinal sides of the supported member.

4. The connection of claim 1, wherein:

the central attachment area and peripheral attachment areas of the connector are formed with one or more openings for the plurality of separate fasteners.

5. The connection of claim 4, wherein:

openings for receiving the plurality of separate fasteners are only provided in the central attachment area and the peripheral attachment areas.

6. The connection of claim 1, wherein:

the left and right side strengthening areas are formed with longitudinally extending flanges that jut outwardly from the central attachment along the depth axis.

7. The connection of claim 1, wherein:

the strengthening areas are formed with longitudinal ends and the longitudinal ends of the strengthening areas are disposed adjacent the peripheral attachment areas.

8. The connection of claim 7, wherein:

the connector is elongated with respect to the longitudinal axis such that the connector extends father along the longitudinal axis than it does along the lateral axis, and the connector is relatively thin such that the connector extends farther along the lateral axis than it does along the depth axis.

9. The connection of claim 8, wherein:

the peripheral attachment areas extend away from the central attachment area sufficiently that they present exposed areas over which the end face of the supported member does not overlie and extend past the one or more longitudinal sides of the supported member.

10. The connection of claim 9, wherein:

a. the central attachment area has a selected cross-sectional area in a plane defined by the lateral axis and the depth axis at a selected location away from the junctions with the peripheral attachment areas, and b. the junctions where the peripheral attachment areas join with the central attachment area have cross-sectional areas in the plane defined by the lateral axis and the depth axis that are much less than that of the selected cross-sectional area of the central attachment area at the selected location away from the junctions with the peripheral attachment areas.

11. The connection of claim 10, wherein:

the central attachment area and peripheral attachment areas of the connector are formed with one or more openings for the plurality of separate fasteners.

12. The connection of claim 11, wherein:

openings for receiving the plurality of separate fasteners are only provided in the central attachment area and the peripheral attachment areas.

13. The connection of claim 11, wherein:

the left and right side strengthening areas are formed with longitudinally extending embossments.

14. The connection of claim 11, wherein:

the left and right side strengthening areas are formed with longitudinally extending flanges that jut outwardly from the central attachment along the depth axis.

15. The connection of claim 1, wherein:

the left and right side strengthening areas are formed with longitudinally extending embossments.

* * * * *